United States Patent [19]

Lunt

[11] Patent Number: 4,897,885

[45] Date of Patent: Feb. 6, 1990

[54] ONE-PIECE INFANT BUNTING

[76] Inventor: Audrey T. Lunt, 6371 Vermont Hill Rd., South Wales, N.Y. 14139

[21] Appl. No.: 324,753

[22] Filed: Mar. 17, 1989

[51] Int. Cl.[4] ..... A41B 13/06

[52] U.S. Cl. ..... 2/69.5; 2/70; 2/75; 2/80

[58] Field of Search ..... 2/69.5, 70, 75, 80, 2/104, 114, 2.1 A, 2.5

[56] References Cited

U.S. PATENT DOCUMENTS

| | | | |
|---|---|---|---|
| 782,819 | 2/1905 | Bilké | 2/114 |
| 2,008,919 | 7/1935 | Milkes | 2/69.5 |
| 2,227,751 | 1/1941 | Idelman | 2/69.5 |
| 2,675,552 | 4/1954 | Jackson | 2/69.5 |
| 3,412,407 | 11/1963 | Key | 2/69.5 |
| 3,739,399 | 6/1973 | Sheahon | 2/69.5 |
| 3,839,756 | 10/1974 | Hibbert et al. | 2/69.5 |
| 3,857,125 | 12/1974 | Hunt | 2/69.5 |
| 4,196,245 | 4/1980 | Kitson et al. | 2/DIG. 7 X |
| 4,382,303 | 5/1983 | Lunt | 2/69.5 X |
| 4,514,455 | 4/1985 | Hwang | 428/362 X |
| 4,569,874 | 2/1986 | Kuznetz | 2/69.5 |
| 4,616,365 | 10/1986 | Lyons | 2/69.5 |
| 4,630,320 | 12/1986 | VanGompel | 2/68 X |
| 4,662,006 | 5/1987 | Ross, Jr. | 2/158 |
| 4,674,130 | 6/1987 | Coudron | 2/69.5 |
| 4,688,282 | 8/1987 | Jeffries | 2/69.5 X |
| 4,718,124 | 1/1988 | Sawicki et al. | 2/114 |
| 4,738,119 | 4/1988 | Zafred | 2/81 X |
| 4,745,636 | 5/1988 | Lunt | 2/403 |

FOREIGN PATENT DOCUMENTS

| | | | |
|---|---|---|---|
| 32557 | 7/1962 | Finland | 2/69.5 |
| 997069 | 12/1951 | France | 2/69.5 |
| 1002742 | 3/1952 | France | 2/69.5 |

OTHER PUBLICATIONS

Gershman, Maurice, "Self Adhering Nylon Tapes." The J.A.M.A., vol. 168, No. 7, Oct. 1958, p. 930.

*Primary Examiner*—Werner H. Schroeder
*Assistant Examiner*—Jeanette E. Chapman
*Attorney, Agent, or Firm*—Michael Ebert

[57] ABSTRACT

An infant bunting formed from a single blank of multilayer fabric material in which a thermal insulation core layer is sandwiched between inner and outer facing layers, the periphery of the blank being ultrasonically welded to create a continuous hem. The blank is contoured to define a rectangular main section provided with a lower extension forming a closure section and an upper extension whose corners are folded in and joined to form a triangular hood section for receiving the head of an infant. The opposing sides of the main section are foldable to overlap the infant's body, arms and legs to form a pouch which is held together by Velcro fasteners. The closure extension is foldable over the pouch and held thereto by a Velcro fastener to lock in the feet of the infant.

7 Claims, 2 Drawing Sheets

Fig. 2.
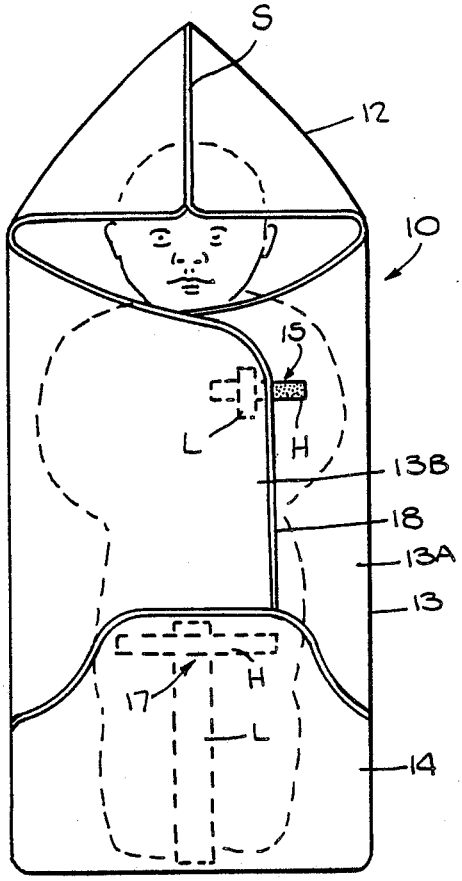
Fig. 1.
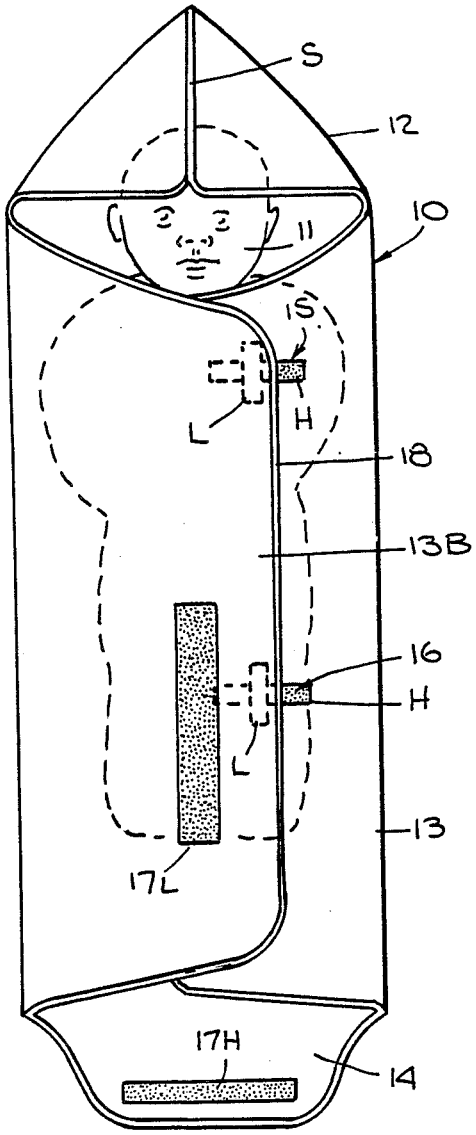
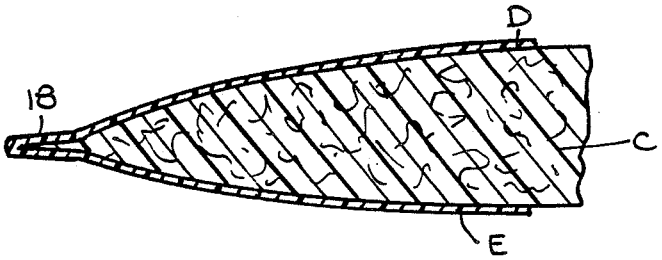
Fig. 3.

ONE-PIECE INFANT BUNTING

BACKGROUND OF INVENTION

1. Field of Invention:

This invention relates generally to neonatal bunting, and more particularly to a bunting for infants formed from a single-piece blank of multi-layer fabric material which includes a thermal-insulation layer to keep the infant warm.

2. Status of Prior Art:

Bunting refers to a sleeping bag for an infant, the bag being traditionally made of thickly napped fabric. A newborn child is vulnerable to heat losses, for his ability to regulate body temperature is not yet fully operative. Bunting, if properly designed, performs an important function, for it serves to maintain a fullterm newborn or a premature infant in thermal balance; that is, in neither a cold-stressed nor an overheated state.

Unless a newborn infant is kept warm, the child may lose heat faster than he can replace it. In the heat-draining environment of a typical nursery, the resultant loss of heat may deplete the infant of essential stores of fat and glycogen, the latter being the principal form in which carbohydrates are stored in human tissue. These energy sources could better be used toward normal infant growth and development. Hence the purpose of bunting is not merely to keep an infant warm and comfortable, for this warmth is essential to proper development. Because a premature newborn is more vulnerable to heat loss, it is vital that this infant be maintained in a thermally balanced environment.

Neonatal bunting are known which are adapted to substantially reduce heat loss in premature and full-term neonates; that is, in infants less than one month old. In neonatal bunting marketed by the 3M Company of St. Paul, Minnesota (Models 8803 and 8805), use is made of a multi-layer fabric having a thin core layer of "Thinsulate" thermal insulation sandwiched between inner and outer facings. Thinsulate is formed of a mixture of polyolefin and polyester fibers and has greater warmth than down, and nearly twice the warmth of high-loft fiberfill insulation when equal thicknesses are compared. It is breathable, moisture resistant and can be washed or dry cleaned.

In a neonatal bunting of the type marketed by 3M, more than one piece of the fabric material is required to form the bunting, for the hood of the bunting is defined by a separate piece that is sewn onto a base fabric. The hem of this bunting material is also sewn, as a consequence of which the cost of manufacturing this bunting is relatively high.

Sewing procedures are also required in the bunting disclosed in the Milkes U.S. Pat. No. 2,008,919 in which several pieces of fabric are sewn together to form a hood and a bottom flap to lock in the feet of the infant. In this bunting, use is also made of a slide fastener and straps.

Also of prior art interest are the buntings disclosed in the patents to Dern, 1,584,853; Bouma, 4,597,141; Douez, 4,726,076; Junghans, 2,538,420; Lyons, 4,616,365, Als et al., 4,611,353 and Berman, 2,441,745. But in all of these prior art buntings, the nature of their structure is relatively complex and is such as to require sewing operations, and in some cases buttons to hold the bunting together.

SUMMARY OF INVENTION

In view of the foregoing, the main object of this invention is to provide a neonatal bunting formed of a single-piece contoured blank without sewing, use being made of a multi-layer fabric whose hem is produced by ultrasonic welding.

More particularly, an object of this invention is to provide a bunting of the above type formed of a single die-cut blank of multi-layer fabric which includes a core layer formed of thermal insulation material sandwiched between non-woven inner and outer layers, the periphery of the blank being ultrasonically welded to create a continuous hem.

A significant advantage of the invention is that it is provided with Velcro fasteners which are ultrasonically welded to the blank and which make it possible to form a single size bunting whose dimensions are adjustable to accommodate infants of varying size ranging from tiny to very large.

Also an object of the invention is to provide a bunting that can be manufactured at relatively low cost, which bunting functions to maintain an infant in a thermally balanced environment.

Briefly stated, these objects are attained in an infant bunting formed from a single blank of multi-layer fabric material in which a thermal insulation core layer is sandwiched between inner and outer facing layers, the periphery of the blank being ultrasonically welded to create a continuous hem.

The blank is contoured to define a rectangular main section provided with a lower extension forming a closure section and an upper extension whose corners are folded in and joined to form a triangular hood section for receiving the head of an infant. The opposing sides of the main section are foldable to overlap the infant's body, arms and legs to form a pouch which is held together by Velcro fasteners. The closure extension is foldable over the pouch and held thereto by a Velcro fastener to lock in the feet of the infant.

BRIEF DESCRIPTION OF DRAWINGS

For a better understanding of the invention as well as other objects and further features thereof, reference is made to the following detailed description to be read in conjunction with the accompanying drawings, wherein:

FIG. 1 illustrates an infant fully wrapped in a bunting in accordance with the invention;

FIG. 2 shows the bunting with the feet closure open;

FIG. 3 is a section taken through the fabric from which the bunting is formed;

DESCRIPTION OF INVENTION

Figure 4:
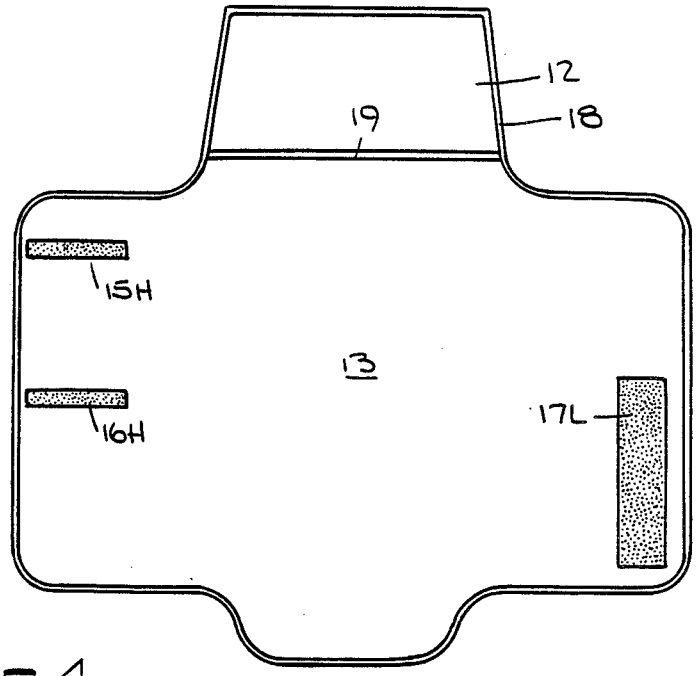
FIG. 4 shows the outside of a single piece blank from which the bunting is formed.

Referring now to FIG. 1, there is shown a neonatal bunting in accordance with the invention, generally designated by numeral 10, to provide a thermally-insulated sleeping pouch for snugly bundling an infant 11. The bunting includes a hood section 12 which receives the head of the infant so that only his face is exposed, a main section 13 which is wrappable about the body and arms and legs of the infant, and a closure section 14 that serves to lock in the feet of the child and is adjustable to his length.

Main section 13 includes overlapping sides 13A and 13B which are held together by a pair of Velcro fasteners 15 and 16. The closure section 14 is held to side 13A of the main section by a Velcro fastener 17.

It is known to use in place of buttons, zippers and other conventional types of fasteners, releasable "Velcro" fasteners which serve to hold together fabric panels or other complementary pieces. A Velcro fastener is constituted by a male or hook component created by a uniform array of stiff hooks, and a female or loop component whose surface is constituted by a pile of tiny soft loops. When the male and female components are pressed together, the hooks become embedded in the loops and are held thereby until the components are peeled apart.

Velcro fasteners are snug, jam proof and washable. The components thereof are available in tape or strip form which can be cut to a desired size. The male hook component, usually fabricated of nylon, is woven in the form of raised loops which are heated to retain their shape, the loops being then clipped to form the desired hooks. The loop or female component is also fabricated of nylon, use being made of a ground tape interwoven with a dense multiplicity of yarns to form a pile surface that is then napped to create a continuous mass of uncut loops designed to couple with the male hooks.

As disclosed in my prior U.S. Pat. No. 4,382,303, it is known to produce garments whose closures are constituted by Velcro fastener components that are ultrasonically welded to fabric panels. Ultrasonic welding may be used to weld together two or more pieces or sheets of thermoplastic material. This is accomplished by interposing the sheets between a "sonotrode" horn and an anvil. The horn is excited into vibration at an ultrasonic frequency and the ultrasonic energy is transformed into heat which softens the thermoplastic sheets and causes them to fuse together. The amount of heat generated is controlled by the adjustable amplitude of ultrasonic vibration.

Each of Velcro fasteners 15, 16, and 17 has a hook component strip H and a loop component strip L at right angles to the hook component. As long as any portion of one component engages a portion of the other component, the fastener is closed. Because of the right angle strip arrangement, the bunting is adjustable to accommodate the size of the infant bundled therein. Thus loop component L of Velcro fastener 17 which is attached to closure section 14 is engageable with any portion of hook component H attached to side 13B of the main section 13. With a long infant, the point of engagement will be toward the bottom of component H to allow room for the feet of the infant. But with a short infant, the engagement is toward the top of component H. In either case, the infant is snugly bundled in the bunting.

The material from which the pouch is made, as shown in FIG. 3, is a multi-layer fabric having a thin core layer C formed of synthetic plastic fiber material having thermal insulation properties, such as "Thinsulate" or "Thintech" also made by 3M, or the fiberfill thermal products made by duPont such as "Thermolite," "Thermoloft," "Hollowfil" and "Quallofil."

Core layer C is sandwiched between inner and outer non-woven facing layers D and E which are vapor permeable so that the bunting material is breathable. Suitable for the inner and outer layers are commercially available non-woven spun laced fabrics which are very soft and drapable, such as the "Sontara" polyester blends produced by duPont. This non-woven fabric is durable and will not tear or abrade, and is fusable when subjected to ultrasonic energy. It also meets federal standards for non-flammability, and is non-allergenic as well as heat sterilizable.

Figure 5:
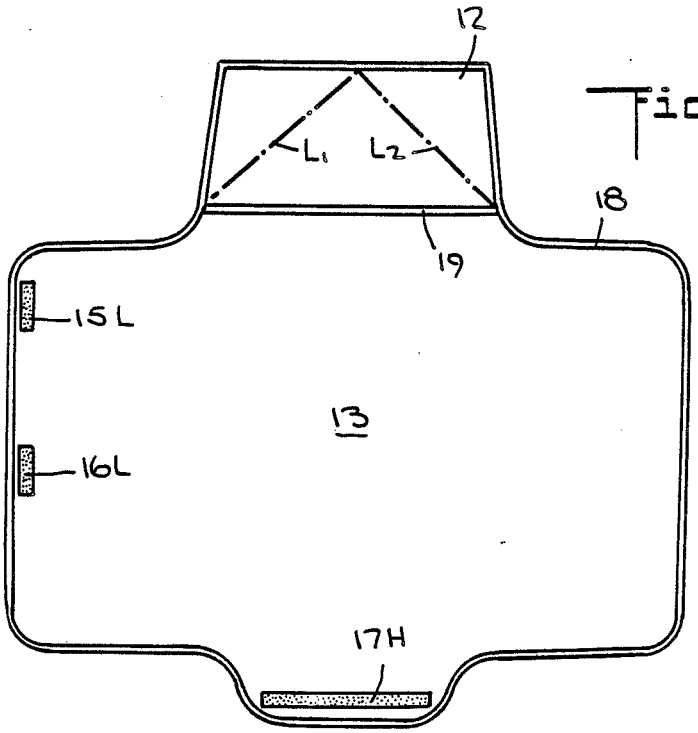
FIG. 5 shows the inside of this blank.

As shown in FIGS. 4 and 5, the bunting is made from a die-cut single piece of multi-layer fabric material which is contoured to define a rectangular main section 13, an upper extension forming the hood section 12 and a lower extension forming the closure section 14. The contoured periphery of the blank is ultrasonically welded to create a continuous hem 18.

The corners of the upper hood section 12 are folded in along diagonal lines $L_1$ and $L_2$ which define the boundaries of the corners and are seamed together ultrasonically along their abutting edges S to form the triangular hood shown in FIG. 1.

A transverse band or line 19 is ultrasonically welded across the hood section 12 to define a living neck hinge for the hood, thereby making it possible to fold back the hood without difficulty. It also serves to seal the core layer of the multi-layer fabric to the inner and outer layers thereof to prevent the shifting of the inner layer into the baby's face, which might otherwise happen if this layer were loose.

Thus to manufacture the bunting, all that is required is to die-cut the one-piece blank out of a sheet of the multi-layer fabric material, then ultrasonically weld hem 18 and neck line 19, after which the triangular hood is created by folding in the corners of the hood section 12 and welding their edges together to form seam S. Finally, the components of the Velcro fasteners 15, 16 and 17 are welded to the bunting at the places indicated in FIGS. 4 and 5.

It is a simple matter to bundle an infant in the bunting, for all that is involved is to lay the infant on the flat, open main section 13 so that its head lies within the triangular hood, and then fold sides 13A and 13B of the main section in overlapping relation over the infant to snugly hold the infant in place, this condition being maintained by Velcro fasteners 15 and 16. Finally, the closure section 14 is folded over the overlapping sides of the main section to lock in the infant's feet, this condition being maintained by Velcro fastener 17.

While there has been shown and described a preferred embodiment of a one-piece infant bunting in accordance with the invention, it will be appreciated that many changes and modifications may be made therein without, however, departing from the essential spirit thereof. Thus the invention is not limited to the particular multi-layer fabric material disclosed herein, for it can be realized with other ultrasonically sealable materials having acceptable bunting properties, both with respect to thermal insulation, breathability and comfort.

I claim:

1. An infant bunting formed from a single die-cut blank of ultrasonically sealable fabric material, the blank being contoured to define a rectangular main section having opposing sides and provided with a lower extension forming a closure section and an upper extension whose corners are folded in and ultrasonically seamed at their abutting edges to form a triangular hood section, the opposing sides of the main section being folded over the infant's body, arms and legs in overlapping relation to form a pouch which is held together by at least one Velcro fastener having hook and loop components which are ultrasonically welded to the respective sides, the closure section being foldable over the pouch to lock in the feet of the infant and being held to the pouch by a Velcro fastener, one of whose components is ultrasonically welded to the closure section, the other to one of said sides, said fabric material having multiple layers including a core layer formed of thermal insulation and a band ultrasonically welded across the upper extension to seal the core layer to the other layers of the material and to define a living neck hinge.

2. An infant bunting as set forth in claim 1, wherein said contoured blank is ultrasonically welded along its periphery to form a continuous hem.

3. A bunting as set forth in claim 1, wherein core layer is sandwiched between inner and outer layers, which layers are ultrasonically welded together along their periphery to form said hem.

4. A bunting as set forth in claim 3, wherein said core layer is thin and is formed of polyolefin fibers.

5. A bunting as set forth in claim 4, wherein said inner and outer layers are formed of non-woven synthetic fibers.

6. A bunting as set forth in claim 1, wherein said components are in strip form, the hook component strip being at right angles to the loop component strip.

7. A bunting as set forth in claim 1, wherein said Velcro fasteners are made of nylon.

* * * * *